US005396563A

United States Patent [19]

Yoshimi

[11] Patent Number: 5,396,563

[45] Date of Patent: Mar. 7, 1995

[54] EARPHONE

[75] Inventor: Toshikazu Yoshimi, Kawagoe, Japan

[73] Assignee: Pioneer Electronic Corporation, Tokyo, Japan

[21] Appl. No.: 249,663

[22] Filed: May 26, 1994

Related U.S. Application Data

[63] Continuation of Ser. No. 892,272, Jun. 2, 1992, abandoned.

[30] Foreign Application Priority Data

Jun. 3, 1991 [JP] Japan ..... 3-131436
Apr. 28, 1992 [JP] Japan ..... 4-110150

[51] Int. Cl.[6] ..... H04R 25/00
[52] U.S. Cl. ..... 381/187; 381/183
[58] Field of Search ..... 381/151, 68.3, 187, 381/183

[56] References Cited

U.S. PATENT DOCUMENTS 2,148,477 2/1939 Koch .
4,025,734 5/1977 Aloupis .
4,652,702 3/1987 Yoshii ..... 381/68.3
4,756,312 7/1988 Epley ..... 128/420.5
4,975,967 12/1990 Rasmussen .
5,073,947 12/1991 Reddemann .
5,125,032 6/1992 Meister et al. ..... 381/183

FOREIGN PATENT DOCUMENTS 3836036 10/1988 Germany .
3916995 7/1989 Germany .
2-21891 2/1990 Japan .
2-75890 6/1990 Japan .

OTHER PUBLICATIONS

European Search Report.
Annex to the European Search Report on European Patent Application No. EP 92305077.7.

*Primary Examiner*—Curtis Kuntz
*Assistant Examiner*—Sinh Tran
*Attorney, Agent, or Firm*—Kane, Dalsimer, Sullivan, Kurucz, Levy, Eisele and Richard

[57] ABSTRACT

An earphone includes an earplug of sound insulating material which is insertable in the external auditory meatus of an ear, and an elastic vibration generator responsive to an electric signal supplied thereto for generating and applying an elastic wave corresponding to the supplied electric signal to an outer end of the earplug inserted in the external auditory meatus. The elastic vibration generator may be held in or out of contact with the earplug, so that the elastic wave generated by the elastic vibration generator can be applied directly or indirectly to the earplug. The earphone may be combined with a helmet or a headband. The earplug is effective to prevent external noise from being transmitted to the ear drum of the ear, and also allows desired sound to be transmitted in the form of an elastic wave reliably and clearly to the ear drum.

23 Claims, 15 Drawing Sheets

EARPHONE

This application is a continuation of application Ser. No. 07/892,272, filed Jun. 2, 1992, now abandoned.

BACKGROUND OF THE INVENTION

1. Field of the Invention

The present invention relates to an earphone, and more particularly to an earphone suitable for use with a radio receiver in a noisy environment such as an automobile racing circuit, a construction site, or the like.

2. Description of the Prior Art

In automobile racing, conversations between the drivers of racing automobiles and pit members or directors are usually transmitted and received typically through transceivers. The driver hears transmitted conversations with a small-size loudspeaker, a headset, or an earphone which is incorporated in a helmet that the driver wears to protect his head. The noise produced by a racing car while it is running has a very high level of up to 100 through 120 dB. While the helmet has a certain noise insulating capability as it covers the driver's ears, such a high racing noise level is excessive enough to make the helmet ineffective as a noise insulation. Conventional earphones are designed for use with audio systems or in low-noise environments, and cannot be used in noisy environments as the transmitted information that is reproduced by the earphones is masked by the noise.

In view of the aforesaid problems, there have been developed earphones with a noise insulating capability as disclosed in Japanese laid-open utility model publications Nos. 2-21891 and 2-75890, for example.

The earphone disclosed in Japanese laid-open utility model publication No. 2-21891 has an acoustic passage extending from an electroacoustic transducer toward an end to be inserted in an external auditory meatus of the user, the acoustic passage being in the form of an air vibratory system. Since sound produced by the electroacoustic transducer is propagated through the air in the acoustic passage by means of wave motion, external noise may leak through a vibratory plate of the electroacoustic transducer and the acoustic passage into the external auditory meatus.

Japanese laid-open utility model publication No. 2-75890 discloses a headset having a vibration damping material for insulating sound. The headset includes pads for covering the user's ears. When the pads are not properly held against the ears, external noise tends to leak through the headset into the external auditory meatus.

Inasmuch as the conventional earphone or headset is designed to propagate sound waves through air, its noise insulating capability is not sufficient in noisy environments such as automobile racing circuits, construction sites, engine compartments on ships, or the like.

SUMMARY OF THE INVENTION

It is an object of the present invention to provide an earphone which is capable of reliably insulating noise when used in noisy environments, and also of clearly transmitting desired information to the user of the earphone.

According to the present invention, there is provided an earphone including an earplug of sound insulating material which is insertable in the external auditory meatus of an ear, and an elastic vibration generator responsive to an electric signal supplied thereto for generating and applying an elastic wave corresponding to the supplied electric signal to an outer end of the earplug inserted in the external auditory meatus.

According to the present invention, there is also provided an earphone including an earplug of sound insulating material which is insertable in the external auditory meatus of an ear, and an elastic vibration generator held in contact with the earplug and responsive to an electric signal supplied thereto for generating and applying an elastic wave corresponding to the supplied electric signal directly to an outer end of the earplug inserted in the external auditory meatus.

According to the present invention, there is further provided an earphone including an earplug of sound insulating material which is insertable in the external auditory meatus of an ear, and an elastic vibration generator held out of contact with the earplug and responsive to an electric signal supplied thereto for generating and applying an elastic wave corresponding to the supplied electric signal indirectly to an outer end of the earplug inserted in the external auditory meatus.

According to the present invention, there is further provided an earphone and helmet assembly including an earplug of sound insulating material which is insertable in the external auditory meatus of an ear, an elastic vibration generator responsive to an electric signal supplied thereto for generating and applying an elastic wave corresponding to the supplied electric signal to an outer end of the earplug inserted in the external auditory meatus, and a helmet shell, the elastic vibration generator being attached to an inner surface of the helmet shell at a position corresponding to the external auditory meatus.

According to the present invention, there is further provided an earphone and headband assembly including an earplug of sound insulating material which is insertable in the external auditory meatus of an ear, an elastic vibration generator responsive to an electric signal supplied thereto for generating and applying an elastic wave corresponding to the supplied electric signal to an outer end of the earplug inserted in the external auditory meatus, and a headband, the elastic vibration generator being attached to the headband at a position corresponding to the external auditory meatus.

The above and other objects, features and advantages of the present invention will become more apparent from the following description when taken in conjunction with the accompanying drawings in which preferred embodiments of the present invention shown by way of illustrative example.

DETAILED DESCRIPTION OF THE PREFERRED EMBODIMENTS

Figure 1:
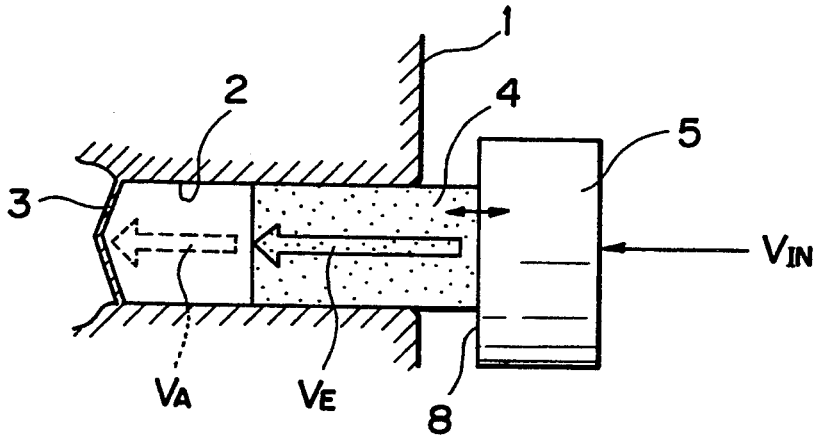
FIG. 1 is a side elevational view, partly in cross section, showing the principles of an earphone according to the present invention.

Like or corresponding parts are denoted by like or corresponding reference characters throughout views.

FIG. 1 illustrates the principles of an earphone according to the present invention.

As shown in FIG. 1, an earphone according to the present invention has an earplug 4 insertable into the external auditory meatus 2 of an ear 1, the earplug 4 being made of a sound insulating material, and an elastic vibration generator 5 responsive to an electric signal $V_{IN}$ applied thereto for generating and transmitting an elastic wave $V_E$ directly to an outer end of the earplug 4 remote from the inner end thereof to be inserted in the external auditory meatus 2. The elastic vibration generator 5 is held in contact with the outer end of the earplug 4 for transmitting the elastic wave $V_E$ directly to the earplug 4.

Since the earplug 4 is made of a sound insulating material and inserted in the external auditory meatus 2 of the ear 1, external noise is prevented from entering the external auditory meatus 2 through the earplug 4. The earplug 4 inserted in the external auditory meatus 2 also serves as a medium for propagating sound, i.e., the elastic wave $V_E$ produced by the elastic vibration generator 5. Therefore, sound, typically voice, from the elastic vibration generator 5 can reliably and clearly be transmitted through the earplug 4 to an ear drum 3. The earplug 4, which serves as an elastic wave propagation medium, is effective to block external noise, and also to propagate the elastic wave $V_E$ efficiently.

The elastic wave $V_E$ generated by the elastic vibration generator 5 can be transmitted highly efficiently to the earplug 4 because the elastic vibration generator 5 is held in contact with the earplug 4 for direct transmission of the elastic wave $V_E$ to the earplug 4.

1ST EMBODIMENT

Figure 2:
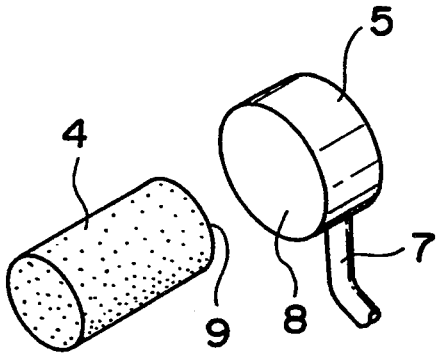
FIG. 2 is an exploded perspective view of an earphone according to a first embodiment of the present invention.
Figure 3:
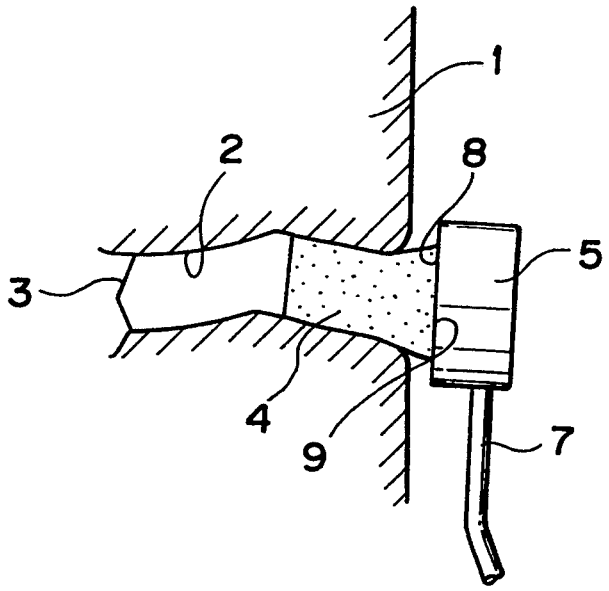
FIG. 3 is a side elevational view showing the manner in which the user uses the earphone according to the first embodiment.

FIGS. 2 through 5 show an earphone according to a first embodiment of the present invention. As shown in FIGS. 2 and 3, the earphone according to the first embodiment comprises a cylindrical or rod-shaped earplug 4 that can be inserted into the external auditory meatus 2 of an ear 1, and a cylindrical exciter 5 (elastic vibration generator) coupled to an outer end of the earplug 4 for generating and applying an elastic wave $V_E$ directly to the earplug 4.

The earplug 4 has an outside diameter slightly larger than the inside diameter of the external auditory meatus 2, and is made of a sound insulating material such as an elastic foamed polymer, e.g., urethane foam, which should preferably have a very high internal loss. When compressed, the earplug 4 is elastically restorable to its original shape. The earplug 4 is as hard as an ear lobe, and has such a degree of elasticity that when in use, it can be compressed by fingers, and after being inserted in the external auditory meatus 2, it will elastically be restored to its original cylindrical shape within an appropriate period of time. When the earplug 4 is restored to its original cylindrical shape after being inserted in the external auditory meatus 2, the earplug 4 has its outer circumferential surface held in intimate contact with the inner wall surface of the external auditory meatus 2 under pressure. Therefore, the earplug 4 is placed in the external auditory meatus 2 tightly enough to acoustically isolate the external auditory meatus 2 from outside of the ear 1 for the prevention of entry of external noise into the external auditory meatus 2. The earplug 4 may also be made of silicone resin, clay, or the like.

The exciter 5 is in the form of a vibrator for generating elastic vibration on a vibratory surface 8. The exciter 5 may comprise a dynamic exciter 5 as shown in FIG. 4 or a magnetic exciter 5 as shown in FIG. 5.

Figure 4:
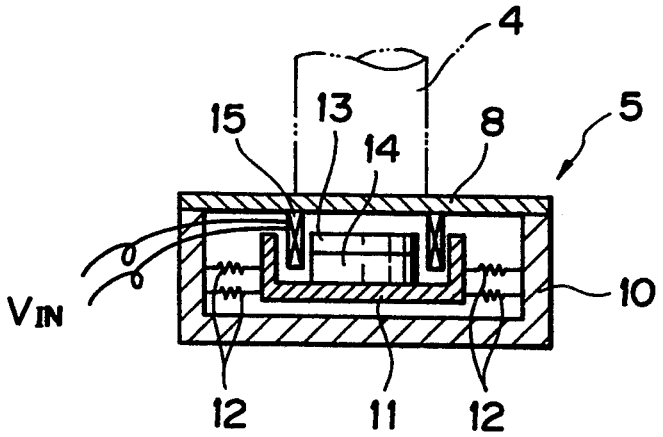
FIG. 4 is a cross-sectional view of a dynamic exciter.

The dynamic exciter 5 shown in FIG. 4 has a bottomed cylindrical casing 10 of synthetic resin with one axial end open, and a circular vibratory plate 8 of metal or magnetic material such as iron mounted on the open axial end, closing the casing 10. The casing 10 houses a bottomed cylindrical yoke 11 suspended therein with a suitable degree of stiffness by dampers 12. The yoke 11 has an open axial end direction in the same direction as the open axial end of the casing 10. An axially extending cylindrical magnet 14 is disposed centrally in the yoke 11, with a circular center pole 13 mounted on the tip of the magnet 14. The inner circumferential surface of the yoke 11 and the outer circumferential surfaces of the magnet 14 and the center pole 13 define a ring-shaped gap therebetween. In the gap there is disposed a ring-shaped voice coil 15 out of contact with the yoke 11, the magnet 14, and the center pole 13, the ring-shaped voice coil 15 having an axial end fixed to the vibratory plate 8. The voice coil 15 is electrically connected to leads 7 (see FIGS. 2 and 3) that extend from a transceiver (not shown). When an electric signal $V_{IN}$ is applied over the leads 7 to the voice coil 15, the yoke 11 vibrates at a frequency corresponding to the frequency of the applied electric signal $V_{IN}$ through the interaction between a magnetic field produced in the gap by a magnetic circuit composed of the yoke 11, the magnet 14, and the center pole 13 and an alternating magnetic field induced by the voice coil 15. The vibration of the yoke 11 appears as elastic vibration on the vibratory plate 8. The outer end of the earplug 4, which is remote from the inner end thereof inserted in the external auditory meatus 2, is held in mechanical contact with the vibratory plate 8, so that an elastic wave $V_E$ is propagated from the vibratory plate 8 through the earplug 4, thereby vibrating the inner end thereof inserted in the external auditory meatus 2.

Figure 5:
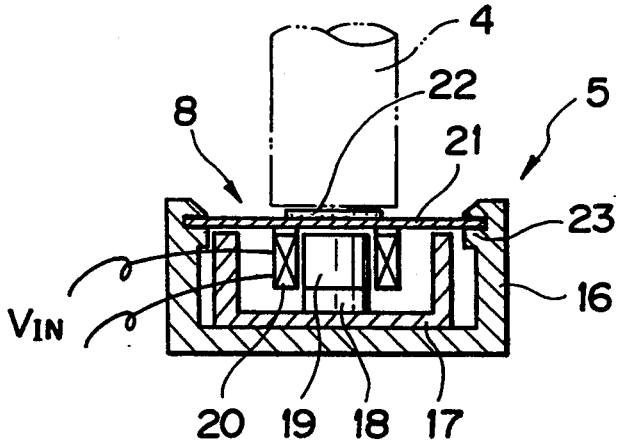
FIG. 5 is a cross-sectional view of a magnetic exciter.

The dynamic exciter 5 shown in FIG. 5 has a bottomed cylindrical casing 16 of synthetic resin with one axial end open, and a circular vibratory plate 21 having an outer circumferential edge fitted in a ring groove 23 defined in the open axial end, closing the casing 16. The casing 16 houses a bottomed cylindrical yoke 17 fixedly mounted on the bottom thereof and has an open axial end directed in the same direction as the open axial end of the casing 16. A cylindrical magnet 18 and a cylindrical center pole 19 which extend axially are disposed centrally on the bottom of the yoke 17. A ring-shaped voice coil 20 is disposed coaxially with and around the center pole 19 out of contact therewith, the ring-shaped voice coil 20 having an axial end fixed to the vibratory plate 21. The voice coil 20 is electrically connected to leads 7 (see FIGS. 2 and 3). When an electric signal $V_{IN}$ is applied over the leads 7 to the voice coil 20, the Vibratory plate 21 vibrates at a frequency corresponding to the frequency of the applied electric signal $V_{IN}$ through the interaction between a magnetic field produced in a gap defined by a magnetic circuit composed of the yoke 17, the magnet 18, and the center pole 19 and an alternating magnetic field induced by the voice coil 20. The vibration of the vibratory plate 21 is elastic vibration. The outer end of the earplug 4, which is remote from the inner end thereof inserted in the external auditory meatus 2, is held in mechanical contact with the vibratory plate 21, so that an elastic wave $V_E$ is propagated from the vibratory plate 8 through the earplug 4, thereby vibrating the inner end thereof inserted in the external auditory meatus 2.

The exciter 5 is not limited to the structures shown in FIGS. 4 and 5, but may be of any structures insofar as they can produce elastic vibration.

As shown in FIGS. 2 and 3, the earplug 4 and the exciter 5 are joined to each other through the outer end of the earplug 4, which serves as a vibration receiving surface 9, and the vibratory surface or plate 8 of the exciter 5. The earplug 4 and the exciter 5 may be integrally fixed to each other in advance, but should preferably be separate from each other so that they can easily be joined to each other when in use.

As shown in FIG. 1, the electric signal $V_{IN}$ applied to the exciter 5 is converted into mechanical vibration by the exciter 5. The mechanical vibration produced by the vibratory plate 8 is transmitted as an elastic wave $V_E$ from the vibratory plate 8 through the vibration receiving surface 9 into the earplug 4. The elastic wave $V_E$ is then propagated through the earplug 4 toward the inner end thereof. When the elastic wave $V_E$ reaches the inner end of the earplug 4, the inner end vibrates at the same frequency as the frequency of the applied electric signal $V_{IN}$, radiating a sound wave $V_A$ into the external auditory meatus 2. Since the external auditory meatus 2 is acoustically isolated from the space outside of the ear 1, at this time, the intensity of external noise which may enter the external auditory meatus 2 is very low. Almost all acoustic energy that reaches the ear drum 3 at this time is the sound wave $V_A$ radiated from the inner end of the earplug 4. Consequently, the user of the earphone can clearly hear or perceive the sound reproduced from the sound wave $V_A$ with a low noise background.

2ND EMBODIMENT

Figure 6:
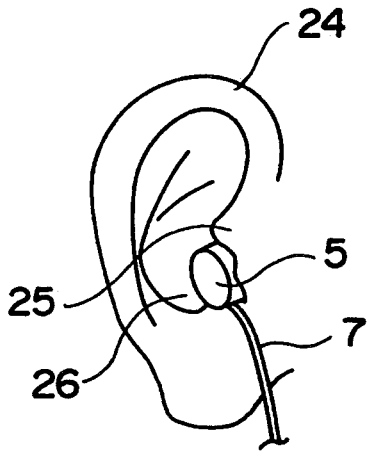
FIG. 6 is a view showing the manner in which the user uses an earphone according to a second embodiment of the present invention.

FIG. 6 shows an earphone according to a second embodiment of the present invention. The earphone according to the second embodiment includes an exciter 5 having such an outer size or profile that it is snugly fitted in the concha 26 of an ear of the user and retained in place against removal by the tragus 25 of the ear.

The outer surface of the exciter 5 is covered with a material having a certain degree of resiliency and a coefficient of friction. Therefore, once placed in the ear of the user, the exciter 5 is securely held in the ear against dislodgement. The material, structure, and shape of the earplug and the internal structure of the exciter 5 are identical to those of the earphone according to the first embodiment.

3RD EMBODIMENT

Figure 7:
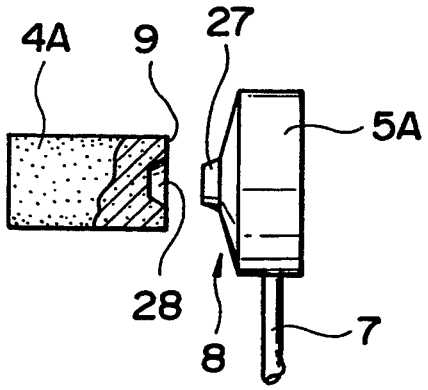
FIG. 7 is an exploded side elevational view, partly in cross section, of an earphone according to a third embodiment of the present invention.

FIG. 7 shows an earphone according to a third embodiment of the present invention. The earphone according to the third embodiment has an earplug 4A and an exciter 5A that are detachably coupled to each other.

The exciter 5A has an outwardly extending protrusion 27 on the center of the vibratory plate 8, and the earplug 4A has a recess 28 defined in the center of the outer end or the vibration receiving surface 9 thereof, for receiving the protrusion 27 therein. The inside diameter of the recess 28 may be slightly smaller than the outside diameter of the protrusion 27, or the protrusion 27 may be progressively larger in diameter toward its tip end and the recess 28 may be progressively smaller in diameter toward its open end, so that the protrusion 27 that is received in the recess 28 is securely retained therein against forces tending to separate the earplug 4A and the exciter 5A.

The earplug 4A and the exciter 5A that are detachably coupled to each other make the earphone usable conveniently. More specifically, when the earphone is to be used, the earplug 4A is first inserted into the external auditory meatus 2, and then the exciter 5A is joined to the earplug 4A. Since the earplug 4A and the exciter 5A can be handled independently, the earphone can be handled with ease when it is placed in the ear which is of a relatively complex structure. The material, structure, and shape of the earplug 4A and the internal structure of the exciter 5A are identical to those of the earphone according to the first embodiment.

4TH EMBODIMENT

Figure 8:
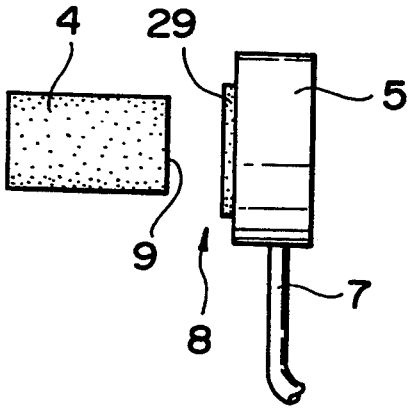
FIG. 8 is an exploded side elevational view of an earphone according to a fourth embodiment of the present invention.

FIG. 8 shows an earphone according to a fourth embodiment of the present invention. The earplug 4 and the exciter 5 of the earphone according to the fourth embodiment are also detachably coupled to each other.

The exciter 5 has an adhesive tape 29 applied to the vibratory plate 8 in a position where the vibration receiving surface 9 of the earplug 4 contacts the vibratory plate 8. In use, the earplug 4 is attached to the exciter 5 by the adhesive tape 29. The adhesive tape 29 should preferably be capable of maintaining its adhering ability even after the earplug 4 is attached to and detached from the exciter 5 a number of times. Inasmuch as the earplug 4 and the exciter 5 are detachably coupled to each other, the earphone according to the fourth embodiment can also be handled with ease. The material, structure, and shape of the earplug 4 and the internal structure of the exciter 5 are identical to those of the earphone according to the first embodiment.

5TH EMBODIMENT

Figure 9:
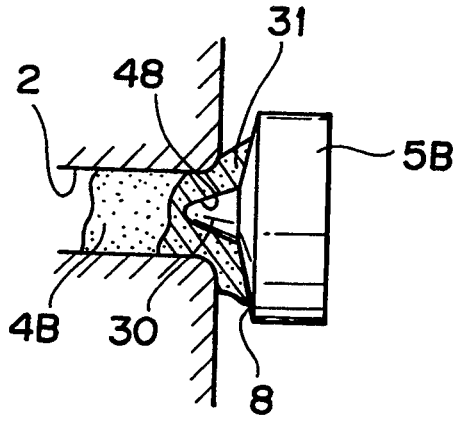
FIG. 9 is a side elevational view, partly in cross section, showing the manner in which the user uses an earphone according to a fifth embodiment of the present invention.

FIG. 9 shows an earphone according to a fifth embodiment of the present'invention. The earphone according to the fifth embodiment has an exciter 5B and an earplug 4B which are designed to enable the earplug 4B to be held in intimate contact with the inner wall surface of the external auditory meatus 2.

The exciter 5B has an outwardly extending tapered protrusion 30 on the center of the vibratory plate 8, and the earplug 4B has a recess 48 defined in the center of the outer end thereof, for receiving the protrusion 30 therein. The tapered protrusion 30 is slightly larger in diameter than the recess 48, so that when the protrusion 30 is inserted in the recess 48, joining the exciter 5C and the earplug 4C to each other, the recess 48 and the portion of the earplug 4B which surrounds the recess 48 are spread radially outwardly. When the earphone is worn by the user, and the exciter 5B and the earplug 4B are coupled to each other, the outer end of the earplug 4B is spread radially outwardly into intimate contact with the open end of the external auditory meatus 2. Therefore, when used in the ear of the user, the earphone according to the fifth embodiment provides an increased sound insulating capability against the entry of external noise into the external auditory meatus 2. The material, structure, and shape of the earplug 4B and the internal structure of the exciter 5B are identical to those of the earphone according to the first embodiment.

6TH EMBODIMENT

Figure 10:
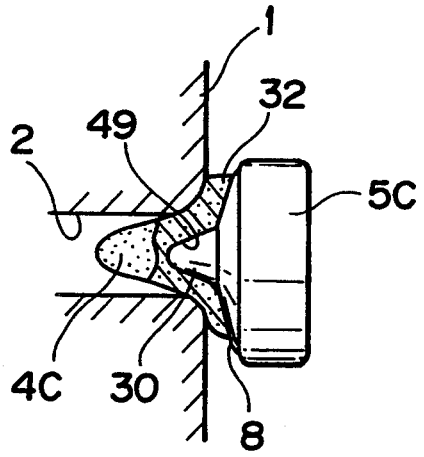
FIG. 10 is a side elevational view, partly in cross section, showing the manner in which the user uses an earphone according to a sixth embodiment of the present invention.

FIG. 10 shows an earphone according to a sixth embodiment of the present invention. The earphone according to the sixth embodiment includes a conically tapered earplug 4C that can easily be inserted more intimately into the external auditory meatus 2.

The earplug 4C has a recess 49 defined in the outer end thereof. The earphone also includes an exciter 5C which has an outwardly extending tapered protrusion 30 on the center of the vibratory plate 8, which is to be received in the recess 49. The tapered protrusion 30 is slightly larger in diameter than the recess 49. When the protrusion 30 is inserted in the recess 49, joining the exciter 5C and the earplug 4C to each other, the recess 49 and the portion of the earplug 4C which surrounds the recess 49 are spread radially outwardly. When the earphone is worn by the user, and the exciter 5C and the earplug 4C are thus coupled to each other, the outer end of the earplug 4C is spread radially outwardly as an expanded portion 32 which is pressed against held in intimate contact with the open end of the external auditory meatus 2. Therefore, when used in the ear of the user, the earphone according to the sixth embodiment provides an increased sound insulating capability against the entry of external noise into the external auditory meatus 2. The material of the earplug 4C and the internal structure of the exciter 5C are identical to those of the earphone according to the first embodiment.

7TH EMBODIMENT

Figure 11:
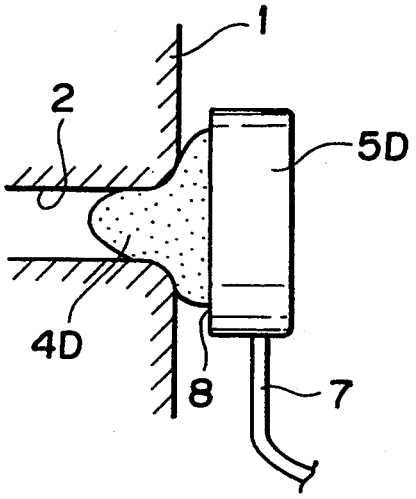
FIG. 11 is a side elevational view showing the manner in which the user uses an earphone according to a seventh embodiment of the present invention.

FIG. 11 shows an earphone according to a seventh embodiment of the present invention. The earphone according to the seventh embodiment comprises an exciter 5D and a conically tapered earplug 4D for easy insertion into and intimate contact with the inner circumferential surface of the external auditory meatus 2.

The earplug 4D has a bottom, i.e., the outer end thereof, bonded to the vibratory plate 8 of the exciter 5D by an adhesive or the like which prevents the exciter 5D and the earplug 4D from being detached from each other once bonded together. Because the earplug 4D and the exciter 5D are firmly joined to each other, the earphone can be worn by the user in one operation, or the user is not required to attach the earplug 4D and the exciter 5D separately, i.e., to insert the earplug 4D into the external auditory meatus 2 and then attach the exciter 5D to the earplug 4D. The conically tapered shape of the earplug 4D prevents itself from being inserted into the external auditory meatus 2 as deeply as the cylindrical earplug such as shown in FIGS. 2 and 3, and hence has a lower sound insulating capability against the entry of external noise. However, the earphone with the conically tapered earplug is much better at noise prevention and sound perception than conventional earphones in medium noise level. When the earphone with the conically tapered earplug is used with an audio system, the leakage of reproduced sound from the earphone into the space outside of the ear is quite low. Therefore, the earphone can effectively be used with a portable cassette recorder.

8TH EMBODIMENT

Figure 12:
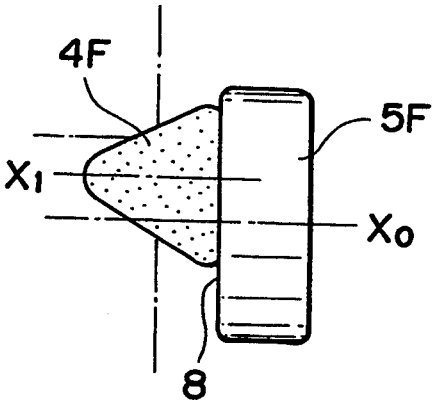
FIG. 12 is a side elevational view of an earphone according to an eighth embodiment of the present invention.

FIG. 12 shows an earphone according to an eighth embodiment of the present invention.

The earphone shown in FIG. 12 has an exciter 5F and a conically tapered earplug 4F which are integrally joined to each other, the earplug 4F having a central axis $X_1$ displaced off the central axis $X_0$ of the exciter 5F. It is known that the central axis of the external auditory meatus 2 is usually not aligned with, but displaced from, the central axis of the concha of the ear. Based on the average distance between the central axis of the external auditory meatus and the central axis of the concha among possible users, the central axis $X_1$ of the earplug 4F is displaced off the central axis $X_0$ of the exciter 5F for allowing the earphone to be fitted neatly in the ear. Another advantage is that since the exciter 5F may be increased in size by the distance between the central axis $X_1$ of the earplug 4F and the central axis $X_0$ of the exciter 5F, the exciter 5F may have an increased driving capability for better sound reproduction.

9TH EMBODIMENT

Figure 13:
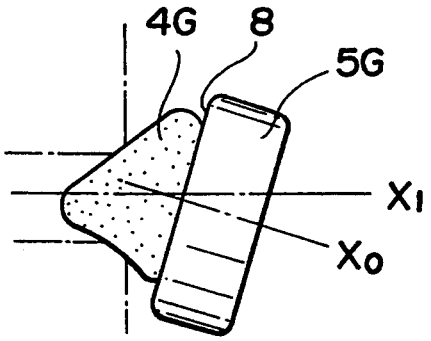
FIG. 13 is a side elevational view of an earphone according to a ninth embodiment of the present invention.
Figure 14:
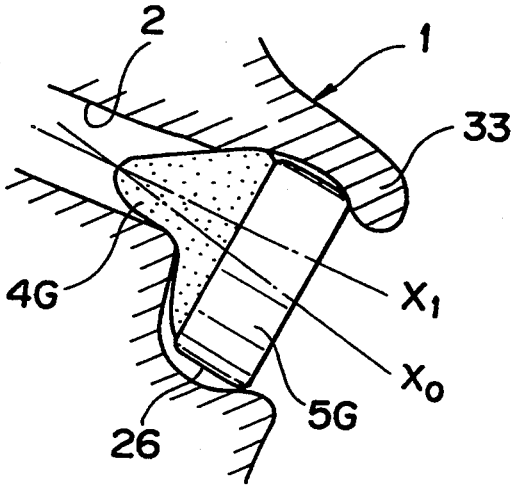
FIG. 14 is a side elevational view, partly in cross section, showing the manner in which the user uses the earphone according to the ninth embodiment of the present invention.

FIGS. 13 and 14 show an earphone according to a ninth embodiment of the present invention.

The earphone shown in FIG. 13 has an exciter 5G and a conically tapered earplug 4G which are integrally joined to each other, the exciter 5G having a central axis $X_0$ inclined a certain angle to the central axis $X_1$ of the earplug 4G. The exciter 5G which is thus inclined to the earplug 4G can snugly be fitted in the concha 26 (see FIG. 14) of the ear, and, after fitted, is less liable to be detached from the concha 26. Since the exciter 5G is inclined with respect to the axis of the external auditory meatus 2 when placed in the ear, the exciter 5G is positioned clear of projecting portions of the ear. Accordingly, the exciter 5G may be increased in size for a higher driving capability.

In the above embodiments, the earplugs are of a uniform hardness, density, or material throughout their cylindrical or conical shape. However, the earplug of an earphone according to the present invention may be of an internal structure having a plurality of regions of different hardnesses, densities, or materials, as shown in FIGS. 15 through 19.

Figure 15:
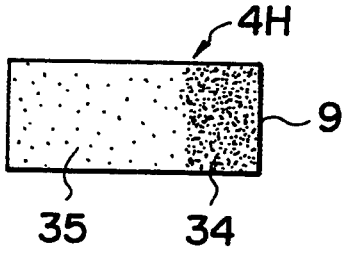
FIG. 15 is a side elevational view of an earplug according to a first modification.

FIG. 15 shows an earplug 4H which is heavier and harder in a region 34 near the outer end or the vibration receiving surface 9 held against an exciter, and which is lighter and softer progressively or stepwise in a region 35 toward the inner end. Since the exciter is much heavier and harder than the earplug 4H as a whole, an elastic wave transmitted from the exciter into the earplug 4H is subject to a transmission loss. The heavier and harder region 34 of the earplug 4H serves to reduce such a transmission loss because the weight and hardness of the earplug 4H in the region 34 near the outer end which contacts the exciter are closer to those of the exciter. The reduced transmission loss results in an increased elastic wave transmission efficiency for an increased intensity of sound reproduced by the earphone. The earplug 4H of composite properties may be made of either a single material that is processed to provide different densities in different regions of the earplug, or different materials of different hardnesses, densities, and weights that are arranged in different regions of the earplug.

Figure 16:
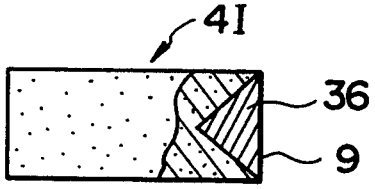
FIG. 16 is a side elevational view, partly in cross section, of an earplug according to a second modification.

FIG. 16 illustrates an earplug 4I including a conical harder member 36 fitted in the outer end or the vibration receiving surface 9 thereof for reducing a transmission loss.

Figure 17:
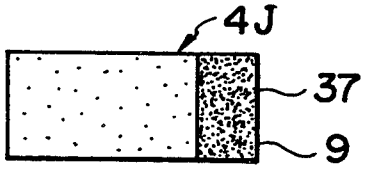
FIG. 17 is a side elevational view of an earplug according to a third modification.

FIG. 17 shows an earplug 4J including a hard member 37 of greater hardness, density, and weight attached to the outer end thereof. The hard member 37 may not necessarily be of the same material as the earplug 4J insofar as it can reduce a transmission loss.

Figure 18A:
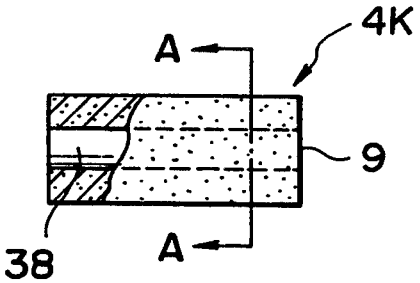
FIG. 18A is a side elevational view, partly in cross section, of an earplug according to a fourth modification.
Figure 18B:
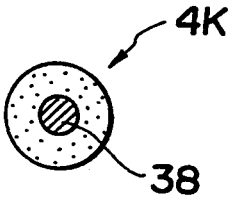
FIG. 18B is a cross-sectional view taken along line A—A of FIG. 18A.

FIGS. 18A and 18B show an earplug 4K including a cylindrical hard core member 38 disposed therein and extending axially therethrough between the inner and outer ends. The hard core member 38 is harder, heavier, and denser than a surrounding softer sleeve member.

Figure 19:
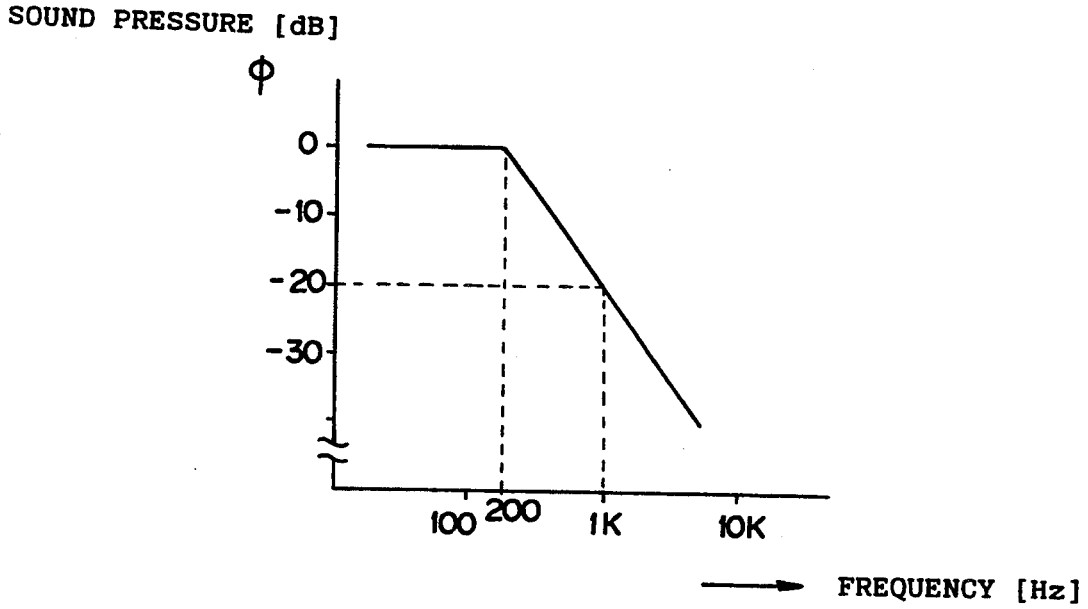
FIG. 19 is a view showing an acoustic transmission spectrum of an earplug made of a single material.

FIG. 19 shows an acoustic transmission characteristic (spectrum) of an earplug made of a single material. When the earplug is made of a single material, upper frequency limit of the sound wave transmitted through the earplug is substantially determined according to an equivalent mass of the vibratory plate in the exciter and a Young's modulus of the earplug. In this case, the earplug nearly functions as a first dimensional low pass filter. An earplug made of a soft material such as a foamed polymer still retains its softness after inserted into an external auditory meatus of an ear, the transmittance of sound waves (pressure) vibrated at a predetermined acceleration decreases at the rate of 6 dB per octave over the frequency of 200 Hz, as shown in FIG. 19. Since a spoken human voice has frequency components in the frequency range over 200 Hz, an earplug having such transmission characteristic provide an indistinctness of the spoken words. In view of this, the hard core member 38 is provided in the earplug 4K so as to reduce the transmission loss through the earplug.

Figures 24A, 24B:
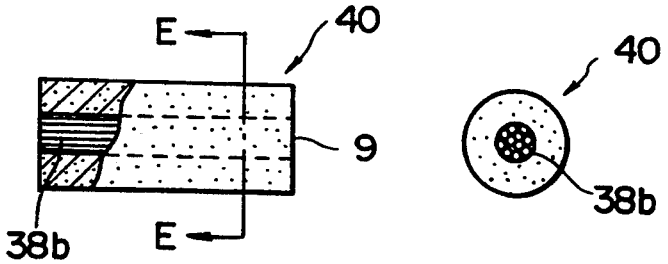
FIG. 24A is a side elevational view, partly in cross section, of an earplug according to a eighth modification.
FIG. 24B is a cross-sectional view taken along line E—E of FIG. 24A.
Figures 25A, 25B:
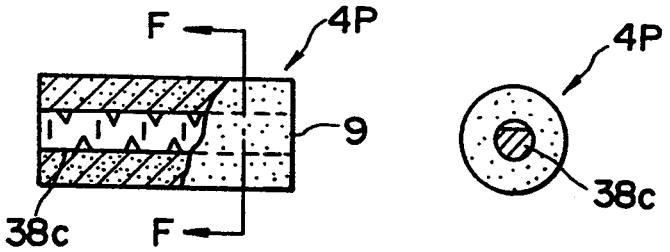
FIG. 25A is a side elevational view, partly in cross section, of an earplug according to a ninth modification.
FIG. 25B is a cross-sectional view taken along line F—F of FIG. 25A.

Other modifications of the earplug having a hard core member are shown in FIGS. 21 through 25. In an earplug shown in FIG. 21, the hard core member 38*a* is covered with the softer sleeve member so as to be inserted into the external auditory meatus without pain or injury thereof. An earplug 4M shown in FIG. 22 has a softer sleeve member surrounding a hard core member 38 and being formed tapering at inner edge thereof to make a smooth insertion possible. An earplug 4N shown in FIG. 23 has a softer sleeve member surrounding a hard core member 38*a* and covering and tapering at inner edge thereof. An earplug 40 shown in FIG. 24 is provided with a core member 38*b* comprised of a plurality of thick core members to produce a flexibility. An earplug 4P shown in FIG. 25 is provided with a core member 38*c* having a plurality of notches at an outer circumferential surface thereof to produce a flexibility.

As a material of the core members 38, 38*a* to 38*c*, a foamed rubber sponge, etc., having a flexibility of hardness of a vinyl chloride polymer, having the Young modulus of 5 to 20, can be used. Alternatively, an urethane foam, a vinyl chloride foam and a polypropylene foam, etc., having an applicability in density and hardness thereof can be used.

Figure 20:
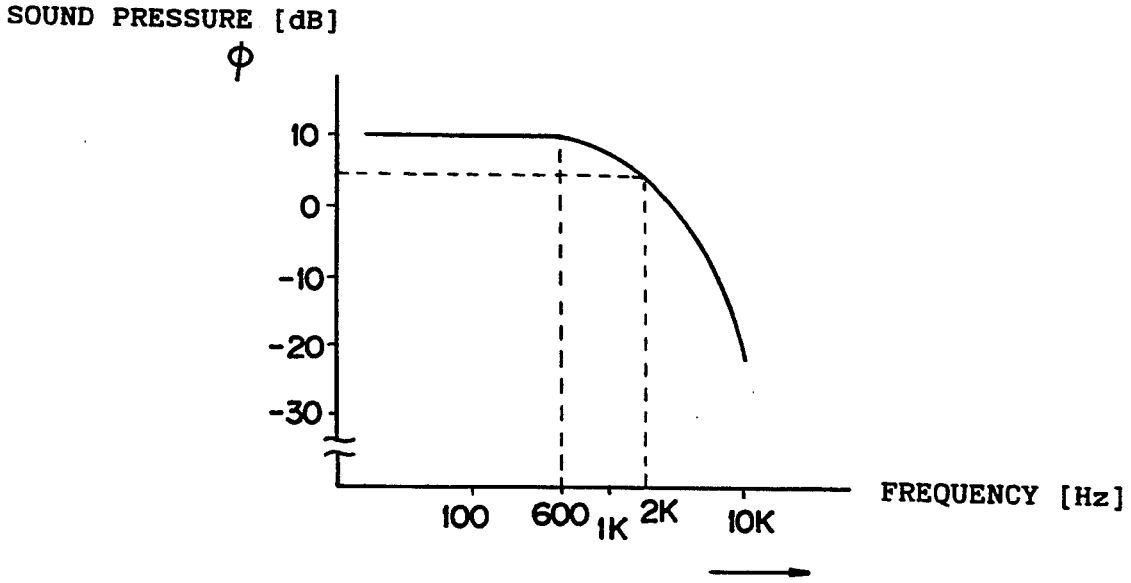
FIG. 20 is a view showing an acoustic transmission spectrum of an earplug made of complex materials.
Figure 21:
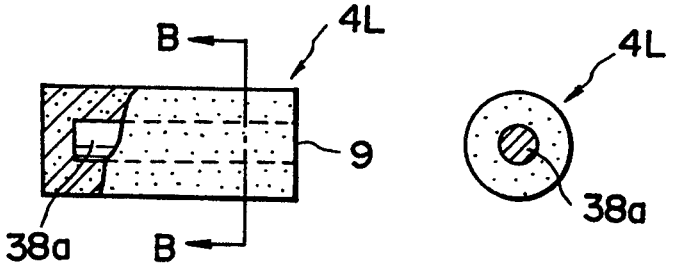
FIG. 21A is a side elevational view, partly in cross section, of an earplug according to a fifth modification.
FIG. 21B is a cross-sectional view taken along line B—B of FIG. 21A.
Figure 22:
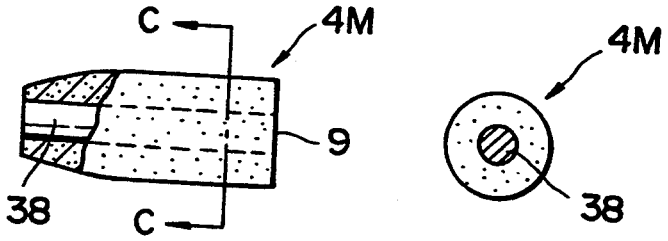
FIG. 22A is a side elevational view, partly in cross section, of an earplug according to a sixth modification.
FIG. 22B is a cross-sectional view taken along line C—C of FIG. 22 A.
Figures 23A, 23B:
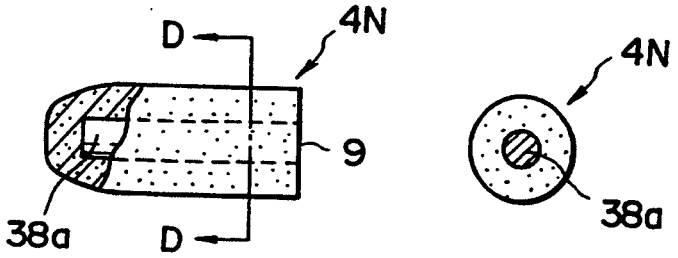
FIG. 23A is a side elevational view, partly in cross section, of an earplug according to a seventh modification.
FIG. 23B is a cross-sectional view taken along line D—D of FIG. 23A.

FIG. 20 shows an acoustic transmission characteristic of an earplug made of complex materials, as described above. As can be seen from FIG. 20, the transmission characteristic is remarkably improved over the frequency of 200 Hz. An elastic wave from the exciter is propagated primarily through the hard core member 38. External noise can be insulated by the softer sleeve member surrounding the hard core member 38. The earplug 4K is therefore effective to increase the intensity of reproduced sound.

Figure 26:
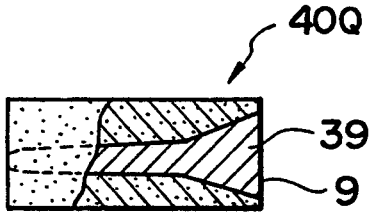
FIG. 26 is a side elevational view, partly in cross section, of an earplug according to a tenth modification.

FIG. 26 shows an earplug 40Q including a sol body 39 disposed therein and extending axially therethrough between the inner and outer ends. The sol body 39 may be a sol of silicone oil or the like. The sol body 39 is encased in a flexible sleeve of high-strength plastic material. The sol body 39 is progressively tapered from the outer end to the inner end of the earplug 4L. As with the earplug 4K shown in FIGS. 18A and 18B, the sol body 39 serves to propagate an elastic wave from the exciter therethrough.

10TH EMBODIMENT

Figure 27:
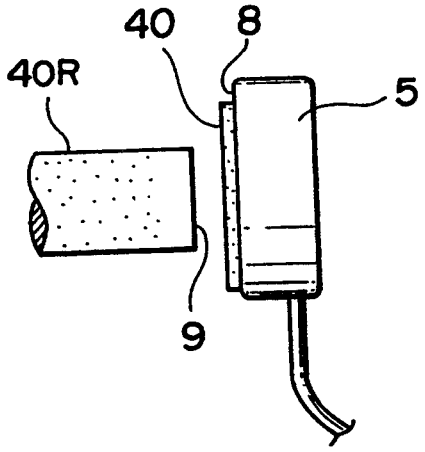
FIG. 27 is an exploded perspective view of an earphone according to a tenth embodiment of the present invention.

FIG. 27 shows an earphone according to a tenth embodiment of the present invention.

The earphone shown in FIG. 27 is arranged to improve acoustic impedance matching between an exciter 5 and an earplug 4M.

As shown in FIG. 27, the exciter 5 of the earphone has a disc-shaped thin large-diameter elastic member 40 bonded to the vibratory plate 8 thereof. The elastic member 40 is of the same material as the earplug 40R, and has a radially larger outer profile or area than the earplug 40R. Since the earplug 40R and the elastic member 40 have the same acoustic characteristics, acoustic impedance matching is achieved between the earplug 40R and the elastic member 40 and hence improved between the earplug 40R and the exciter 5. Consequently, the efficiency with which the elastic wave is transmitted from the exciter 5 to the earplug 40R is increased. The wide area of the elastic member 40 allows the earplug 40R to be positioned relatively freely with respect to the exciter 5. Therefore, the earplug 40R and the exciter 5 may be joined to each other without strict positional limitations, and hence may be handled with ease when they are joined to each other.

Figure 28:
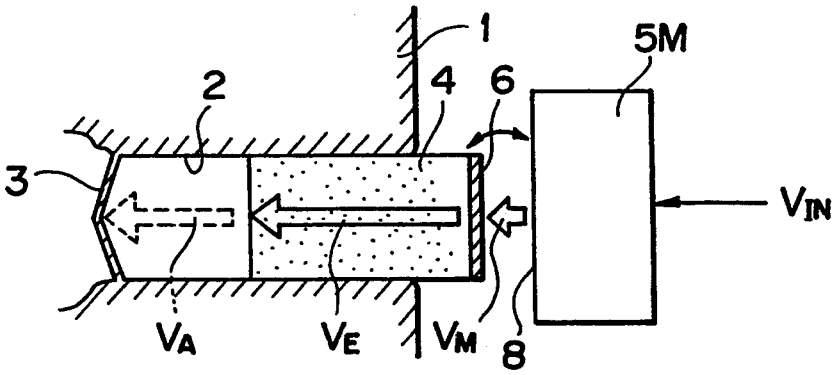
FIG. 28 is a side elevational view, partly in cross section, showing the principles of another earphone according to the present invention.

FIG. 28 shows the principles of another earphone according to the present invention.

As shown in FIG. 28, an earphone according to the present invention has an earplug 4 insertable into the external auditory meatus 2 of an ear 1, the earplug 4 being made of a sound insulating material, and an elastic vibration generator 5M responsive to an electric signal $V_{IN}$ applied thereto for generating and transmitting an elastic wave $V_E$ indirectly to an outer end of the earplug 4 remote from the inner end thereof to be inserted in the external auditory meatus 2. The elastic vibration generator 5M is held out of contact with the outer end of the earplug 4 for transmitting the elastic wave $V_E$ indirectly to the earplug 4.

As with the earphone shown in FIG. 1, the earplug 4, which serves as an elastic wave propagation medium, is effective to block external noise, and also to propagate the elastic wave $V_E$ efficiently. The elastic wave $V_E$ generated by the elastic vibration generator 5M is transmitted indirectly to the earplug 4 which is held out of contact with the elastic vibration generator 5M. Because the elastic vibration generator 5M and the earplug 4 are separate and independent from each other, they can be handled and used freely with ease. If the earphone shown in FIG. 28 is used with a helmet worn by a racing car driver, then the elastic vibration generator 5M is connected to the helmet and the earplug 4 is put in the ear of the driver. The elastic vibration generator 5M and the earplug 4 do not need to be accurately positioned with respect to each other when the helmet is worn by the driver. In addition, the helmet can be put on or taken off quite easily as the elastic vibration generator 5M and the earplug 4 are not joined to each other.

11TH EMBODIMENT

Figure 29:
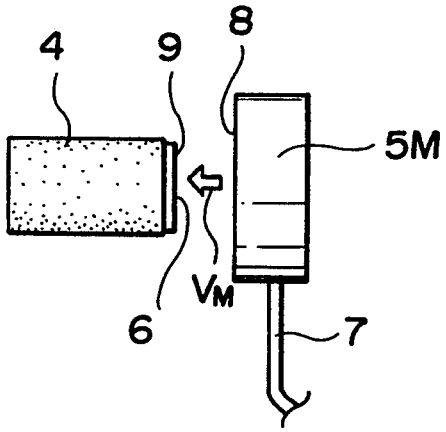
FIG. 29 is an exploded side elevational view of an earphone according to an eleventh embodiment of the present invention.
Figure 30:
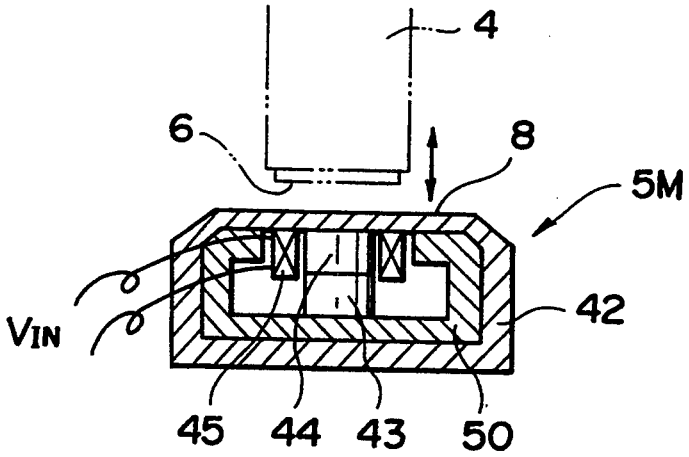
FIG. 30 is a cross-sectional view of an exciter in the earphone according to the eleventh embodiment.

FIGS. 29 and 30 show an earphone according to an eleventh embodiment of the present invention.

As shown in FIG. 29, the earphone comprises an earplug 4 and an exciter 5M which are held out of contact with each other. An elastic wave generated by the exciter 5M is transmitted indirectly (more specifically, magnetically) to the earplug 4.

The earplug 4 is in the shape of a rod or cylinder, and made of a sound insulating material such as an elastic foamed polymer, e.g., urethane foam. When compressed, the earplug 4 is elastically restorable to its original shape. The earplug 4 includes a circular vibratory plate 6 attached to its outer end remote from the inner end to be inserted in the external auditory meatus of an ear, the vibratory plate 6 having a diameter which is substantially the same as that of the earplug 4. The vibratory plate 6 is made of a metal or magnetic material such as iron.

As shown in FIG. 30, the exciter 5M comprises a magnetic generator having a closed hollow cylindrical casing 42 of resin, a bottomed cylindrical yoke 50 disposed in the casing 42, a cylindrical magnet 43 and a cylindrical center pole 44 which are axially joined to each other and disposed centrally in the yoke 50 in the axial direction of the casing 42, and a ring-shaped voice coil 45 placed in a gap defined between the inner circumferential edge of the open end of the yoke 50 and the outer circumferential surface of the magnet 43. The casing 42 has a vibratory surface or plate 8 facing the vibratory plate 6 of the earplug 4. The voice coil 45 is attached to the vibratory plate 8. The magnet 43, the center pole 44, and the yoke 50 jointly make up a magnetic circuit for generating a direct magnetic field, in which the voice coil 45 is placed. When an electric signal $V_{IN}$ is supplied to the voice coil 45, the vibratory plate 8 of the exciter 5M produces an alternating magnetic field which is biased by the direct magnetic field and represents the applied electric signal $V_{IN}$.

The magnetic excitation of the exciter 5M can be transmitted to the earplug 4 which is held out of contact with the exciter 5M. More specifically, in use, the earplug 4 is inserted into the external auditory meatus of an ear of the user such that the vibratory plate 6 faces outwardly of the ear. Then, the vibratory plate 8 of the exciter 5M is placed near the vibratory plate 6 out of contact therewith. When an electric signal $V_{IN}$ is supplied to the voice coil 45, the vibratory plate 8 of the exciter 5M produces an alternating magnetic field $V_M$ (see FIG. 28) corresponding to the electric signal $V_{IN}$. The alternating magnetic field $V_M$ is applied to the vibratory plate 6. The vibratory plate 6 is vibrated, i.e., attracted toward and repelled from the exciter 5M, at a frequency corresponding to the frequency of the alternating magnetic field $V_M$. The vibration of the vibratory plate 6 is propagated as an elastic wave $V_E$ through the earplug 4. When the elastic wave $V_E$ reaches the inner end of the earplug 4, the inner end vibrates at the same frequency as the frequency of the applied electric signal $V_{IN}$, radiating a sound wave $V_A$ into the external auditory meatus 2.

Since the exciter 5M and the vibratory plate 6 are magnetically coupled to each other and the elastic wave $V_E$ is produced and transmitted through the earplug 4 based on such magnetic coupling, the earplug 4 can insulate external noise and transmit sound clearly from the exciter 5M without being physically joined thereto. The exciter 5M and the earplug 4 can easily be handled and are not required to be positionally adjusted strictly with respect to each other as they are separate and independent from each other. The earphone with the exciter 5M and the earplug 4 being separate from each other is advantageous when used in a helmet to be worn by the user because the user can easily put on or take off the helmet with the exciter 5M attached to the helmet and the earplug 4 left in the ear.

12TH EMBODIMENT

Figure 31:
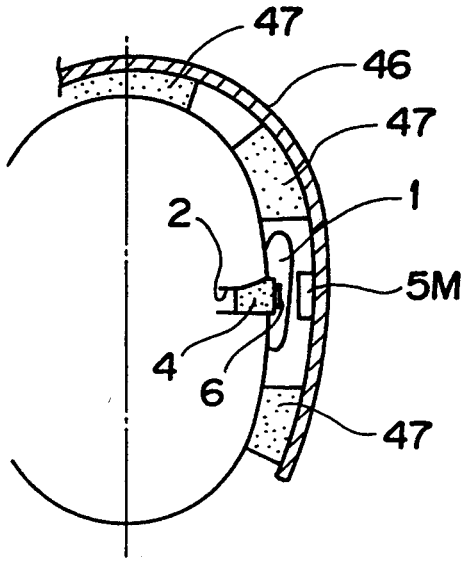
FIG. 31 is a fragmentary cross-sectional view of an earphone according to a twelfth embodiment of the present invention, as it is used by the user.

FIG. 31 illustrates an earphone according to a twelfth embodiment of the present invention.

According to the twelfth embodiment shown in FIG. 31, the earphone is incorporated in a helmet. The earphone comprises an earplug 4 and an exciter 5M which are separate from each other. The earplug 4 and the exciter 5M are identical to those shown in FIGS. 29 and 30. The exciter 5M is attached to an inner surface of a helmet shell 46 at a position corresponding to the external auditory meatus 2 of an ear of the user. In use, the user inserts the earplug 4 into the external auditory meatus 2 with the vibratory plate 6 facing outwardly thereof, and then puts on the helmet shell 46. The helmet includes cushioning pads 47 of vibration damping material attached to the inner surface thereof by adhesive bonding and which, when the helmet is worn, contact the head of the user and holds the exciter 5M spaced from the vibratory plate 6 in the vicinity thereof. The vibratory plate 6 and the exciter 5M are thus maintained out of contact with each other, but magnetically coupled to each other for the transmission of reproduced sound. The earplug 4 can therefore transmit reproduced sound while insulating external noise. The earphone shown in FIG. 31 is particularly suitable for use by the driver of a racing car.

13TH EMBODIMENT

Figure 32:
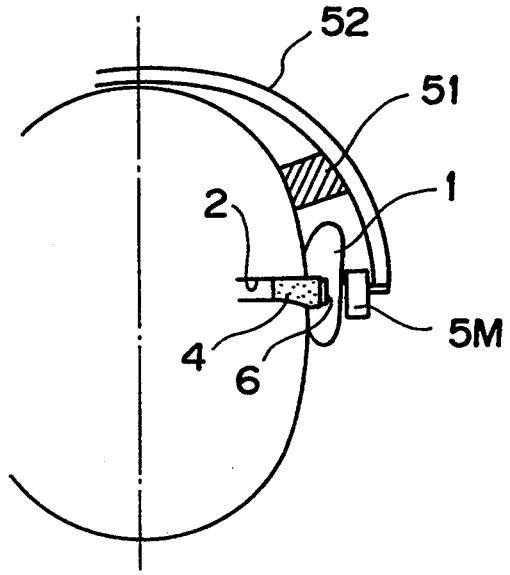
FIG. 32 is a fragmentary cross-sectional view of an earphone according to a thirteenth embodiment of the present invention, as it is used by the user.

FIG. 32 illustrates an earphone according to a thirteenth embodiment of the present invention.

According to the thirteenth embodiment shown in FIG. 32, the earphone is constructed as a headphone. The earphone comprises an earplug 4 and an exciter 5M which are separate from each other, the earplug 4 and the exciter 5M being identical to those shown in FIGS. 29 and 30. The exciter 5M is attached to one end or each end of a headband 52 with a spacer 51 mounted on an inner surface thereof. When the headband 52 is worn by the user, the exciter 5M is spaced from the vibratory plate 6 by the spacer 51. Therefore, the vibratory plate 6 and the exciter 5M are kept out of contact with each other, but magnetically coupled to each other in use. The earphone shown in FIG. 32 is particularly suitable for use by a pit member in a car race paddock.

14TH EMBODIMENT

Figure 33:
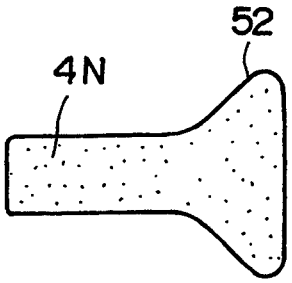
FIG. 33 is a side elevational view of an earplug for an earphone according to a fourteenth embodiment of the present invention.

FIG. 33 shows an earplug for an earphone according to a fourteenth embodiment of the present invention.

The earplug, generally designated by 4N in FIG. 33, is substantially cylindrical or rod-shaped and elongate axially. The earplug 4N has a radially outwardly enlarged portion 52 on its outer end. The axial length of the earplug 4N is such that when the earplug 4N is inserted in the external auditory meatus of an ear, the portion of the earplug 4N, including the enlarged portion 52, which extends out of the external auditory meatus is about 5 mm longer than that of the earplug 4 according to the previous embodiments. The earplug 4N is therefore reliably held in contact with an exciter 5N shown in FIG. 34. The radial size of the enlarged portion 52 may be selected such that when the earplug 4N is inserted in the external auditory meatus, it can easily be handled and nearly fitted in the ear, and the enlarged portion 52 provides a large area of contact with the exciter 5N without strictly positioning the exciter 5N with respect to the enlarged portion 52. The material of the earplug 4N is the same as that of the earplug 4 shown in FIGS. 2 and 3.

Figure 34:
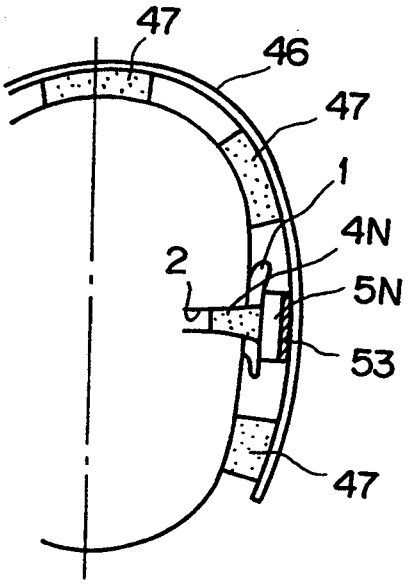
FIG. 34 is a fragmentary cross-sectional view of an earphone according to the fourteenth embodiment, as it is used by the user.

As shown in FIG. 34, the exciter 5N is attached to an inner surface of a helmet shell 46 through a cushioning pad 53 of vibration damping material at a position corresponding to the external auditory meatus 2 of the ear of the user. The cushioning pad 53 serves to acoustically isolate the helmet shell 46 and the exciter 5N from each other for preventing unwanted vibratory noise from being transmitted from the helmet shell 46 to the exciter 5N. The cushioning pad 53 also allows the exciter 5N to apply elastic vibrations generated thereby to the earplug 4N efficiently without being adversely affected by the helmet shell 46 which is heavy. The helmet also includes cushioning pads 47 of vibration damping material attached to the inner surface thereof by adhesive bonding.

In use, the earplug 4N is inserted into the external auditory meatus 2 before the helmet is worn. At this time, the outer end of the earplug 4N projects about 5 mm from the open end of the external auditory meatus 2. Then, when the helmet is worn, the enlarged portion 52 is brought into contact with the exciter 5N. Since the enlarged portion 52 has a large area of contact, it is held in reliable and stable contact with the exciter 5N for efficient transmission of the elastic vibration from the exciter 5N to the earplug 4N even if the earplug 4N is not properly inserted or the exciter 5N is not positioned in exact alignment with the earplug 4N. Accordingly, the earplug 4N and the exciter 5N can be handled with ease, and the elastic wave can be propagated through the earplug 4N efficiently.

The earplug 4N and the exciter 5N with the cushioning pad 53 shown in FIGS. 33 and 34 may be combined with a headband as shown in FIG. 32.

In the above embodiments, the exciter and the transceiver are electrically connected to each other by the leads 7. However, signals can be transmitted from the transceiver to the exciter by a wireless transmission device or radio transmitter.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. An earphone comprising:

an earplug of sound insulating and flexible material for fitting in and shutting an external auditory meatus of an ear so as to acoustically isolate the external auditory meatus from outside the ear; and an elastic vibration generator positioned out of the external auditory meatus and responsive to an electric signal supplied thereto for generating and applying an elastic wave corresponding to the supplied electric signal to an outer end of the earplug inserted in the external auditory meatus, wherein said earplug transmits the elastic wave to an inner end of the earplug, and the inner end of the earplug vibrates at the frequency of the electric signal to permit air confined in a space between the inner end of the earplug and an ear drum of a user to vibrate so that a sound wave corresponding to the electric signal is transmitted to the ear drum.

2. An earphone comprising:

an earplug of sound insulating and flexible material for fitting in and shutting an external auditory meatus of an ear so as to acoustically isolate the external auditory meatus from outside of the ear; and an elastic vibration generator held in contact with said earplug, positioned out of the external auditory meatus, and responsive to an electric signal supplied thereto for generating and applying an elastic wave corresponding to the supplied electric signal directly to an outer end of the earplug inserted in the external auditory meatus, wherein said earplug transmits the elastic wave to an inner end of the earplug, and the inner end of the earplug vibrates at the frequency of the electric signal to permit air confined in a space between the inner end of the earplug and an ear drum of a user to vibrate so that a sound wave corresponding to the electric signal is transmitted to the ear drum.

3. An earphone according to claim 2, wherein said outer end of the earplug and said elastic vibration generator are detachably joined to each other.

4. An earphone according to claim 3, wherein one of said outer end of the earplug and said elastic vibration generator has a recess defined therein, and the other of said outer end of the earplug and said elastic vibration generator has a protrusion fittable in said recess.

5. An earphone according to claim 3, wherein said earplug is made of an elastic material, said outer end of the earplug having a recess defined therein, said elastic vibration generator having a protrusion fittable in said recess, said protrusion having an outside diameter larger than the inside diameter of said recess.

6. An earphone according to claim 3, further including a detachable adhesive member interposed between said outer end of the earplug and said elastic vibration generator.

7. An earphone according to claim 2, wherein said earplug is integrally joined to said elastic vibration generator, said earplug having a tapered inner end insertable in the external auditory meatus.

8. An earphone according to claim 2, wherein said earplug has a central axis displaced off the central axis of said elastic vibration generator.

9. An earphone according to claim 1, wherein said earplug is of a rod-shape made of an elastic material, and includes a harder region near said outer end thereof.

10. An earphone according to claim 1, wherein said earplug is of a rod-shape made of an elastic material, and has a harder member extending axially therethrough.

11. An earphone according to claim 10, wherein said harder member has a flexibility in a radial direction of the earplug.

12. An earphone according to claim 10, wherein said harder member extending axially therethrough between said outer end thereof and an inner end thereof.

13. An earphone according to claim 1, wherein said earplug is of a rod-shape made of an elastic material, and includes a sol member extending axially therethrough between said outer end thereof and an inner end thereof.

14. An earphone according to claim 2, further including a thin member attached to a surface of said elastic vibration generator which is held in contact with said outer end of the earplug, said thin member being of the same material as said earplug.

15. An earphone according to claim 14, wherein said thin member is larger in diameter than said outer end of the earplug.

16. An earphone comprising:

an earplug of sound insulating and flexible material for fitting in and shutting an external auditory meatus of an ear so as to acoustically isolate the external auditory meatus from outside of the ear; and an elastic vibration generator held out of contact with said earplug, positioned out of the external auditory meatus, and responsive to an electric signal supplied thereto for generating and applying an elastic wave corresponding to the supplied electric signal indirectly to an outer end of the earplug inserted in the external auditory meatus, wherein said earplug transmits the elastic wave to an inner end of the earplug, and the inner end of the earplug vibrates at the frequency of the electric signal to permit air confined in a space between the inner end of the earplug and an ear drum of a user to vibrate so that a sound wave corresponding to the electric signal is transmitted to the ear drum.

17. An earphone according to claim 16, wherein said elastic wave generator comprises a magnetic generator for generating a magnetic field corresponding to the electric signal supplied thereto, further including a magnetic member attached to said outer end of the earplug.

18. An earphone and helmet assembly comprising:

an earplug of sound insulating and flexible material for fitting in and shutting an external auditory meatus of an ear so as to acoustically isolate the external auditory meatus from outside of the ear;

an elastic vibration generator positioned out of the external auditory meatus and responsive to an electric signal supplied thereto for generating and applying an elastic wave corresponding to the supplied electric signal to an outer end of the earplug inserted in the external auditory meatus; and a helmet shell, said elastic vibration generator being attached to an inner surface of said helmet shell at a position corresponding to the external auditory meatus, wherein said earplug transmits the elastic wave to an inner end of the earplug, and the inner end of the earplug vibrates at the frequency of the electric signal to permit air confined in a space between the inner end of the earplug and an ear drum of a user to vibrate so that a sound wave corresponding to the electric signal is transmitted to the ear drum.

19. An earphone and helmet assembly according to claim 18, wherein said earplug and said elastic vibration generator are held out of contact with each other, whereby the elastic wave generated by said elastic vibration generator is applied indirectly to said earplug.

20. An earphone and helmet assembly according to claim 18, further including a vibration damping member, said elastic vibration generator being attached to said inner surface of the helmet shell through said vibration damping member, said earplug being of an elongate shape including an enlarged portion at said outer end thereof.

21. An earphone and headband assembly comprising:

an earplug of sound insulating and flexible material for fitting in and shutting an external auditory meatus of an ear so as to acoustically isolate the external auditory meatus from outside of the ear;

an elastic vibration generator positioned out of the external auditory meatus and responsive to an electric signal supplied thereto for generating and applying an elastic wave corresponding to the supplied electric signal to an outer end of the earplug inserted in the external auditory meatus; and a headband, said elastic vibration generator being attached to said headband at a position corresponding to the external auditory meatus, wherein said earplug transmits the elastic wave to an inner end of the earplug, and the inner end of the earplug vibrates at the frequency of the electric signal to permit air confined in a space between the inner end of the earplug and an ear drum of a user to vibrate so that a sound wave corresponding to the electric signal is transmitted to the ear drum.

22. An earphone and headband assembly according to claim 21, wherein said earplug and said elastic vibration generator are held out of contact with each other, whereby the elastic wave generated by said elastic vibration generator is applied indirectly to said earplug.

23. An earphone and helmet assembly according to claim 21, further including a vibration damping member, said elastic vibration generator being attached to said headband through said vibration damping member, said earplug being of an elongate shape including an enlarged portion at said outer end thereof.

* * * * *